US009833078B2

(12) United States Patent
Saghafi

(10) Patent No.: US 9,833,078 B2
(45) Date of Patent: Dec. 5, 2017

(54) SEATED INVERSION CHAIR AND METHOD OF TREATING MIGRAINE HEADACHES

(71) Applicant: Mona Saghafi, Houston, TX (US)

(72) Inventor: Mona Saghafi, Houston, TX (US)

( * ) Notice: Subject to any disclaimer, the term of this patent is extended or adjusted under 35 U.S.C. 154(b) by 0 days.

(21) Appl. No.: 14/219,812

(22) Filed: Mar. 19, 2014

(65) Prior Publication Data

US 2014/0287877 A1 Sep. 25, 2014

Related U.S. Application Data

(60) Provisional application No. 61/804,963, filed on Mar. 25, 2013.

(51) Int. Cl.

| | |
|---|---|
| ***A63B 23/18*** | (2006.01) |
| ***A63B 26/00*** | (2006.01) |
| ***A47C 9/00*** | (2006.01) |
| ***A61H 1/00*** | (2006.01) |
| ***A61H 1/02*** | (2006.01) |
| *A61G 15/00* | (2006.01) |

(52) U.S. Cl.

CPC ..... *A47C 9/002* (2013.01); *A61H 1/003* (2013.01); *A61H 1/0229* (2013.01); *A61H 1/0292* (2013.01); *A61H 1/0296* (2013.01); *A61G 15/007* (2013.01); *A61H 2201/1253* (2013.01); *A61H 2201/164* (2013.01); *A61H 2201/1633* (2013.01); *A61H 2201/1676* (2013.01)

(58) Field of Classification Search

CPC ..... A61H 1/001; A61H 1/005; A61H 1/0218; A61H 2001/0203; A61H 2201/1676; A63B 23/18; A63B 23/0211; A63B 23/0222; A63B 2208/0285; A63B 21/0004; A63B 21/00047; A63B 21/0005; A63B 21/00054; A63B 21/4029; A63B 21/068; A47C 9/002; Y10S 482/907

USPC ..... 297/1, 3, 280, 281, 282, 270.1, 270.2, 297/270.3, 270.4, 270; 482/144

See application file for complete search history.

(56) References Cited

U.S. PATENT DOCUMENTS

| | | | | |
|---|---|---|---|---|
| 3,081,085 A | | 3/1963 | Girolamo | |
| 3,635,526 A | * | 1/1972 | Posey | A61G 5/10 297/488 |
| 4,739,749 A | | 4/1988 | Lindley | |
| 5,334,123 A | | 8/1994 | Rutherford | |
| 5,575,745 A | * | 11/1996 | Lin | A61H 1/0218 482/144 |

(Continued)

*Primary Examiner* — Oren Ginsberg
*Assistant Examiner* — Nyca T Nguyen

(57) ABSTRACT

An inversion chair and the method of treatment are provided to assist a user in the treatment and prevention of migraine headaches by increasing and altering the blood flow within the head. The inversion chair includes a frame having a first and a second side connected to each other by a fixed backrest. The sides of the frame have L-shaped configurations comprising upstanding side and base sections that are connected by a curved member. A rotatable seat is positioned between the sides of the frame. The chair is adapted to transition between a standard sitting position to an inverted position. The chair comprises an upper user support bar and a lower leg support bar for maintaining a user within the chair during inverted use. The support bar is removable and used to either secure the lap of the individual when inverted, or support the chair when in an upright state.

13 Claims, 6 Drawing Sheets

(56) References Cited

U.S. PATENT DOCUMENTS

Figure 1A:
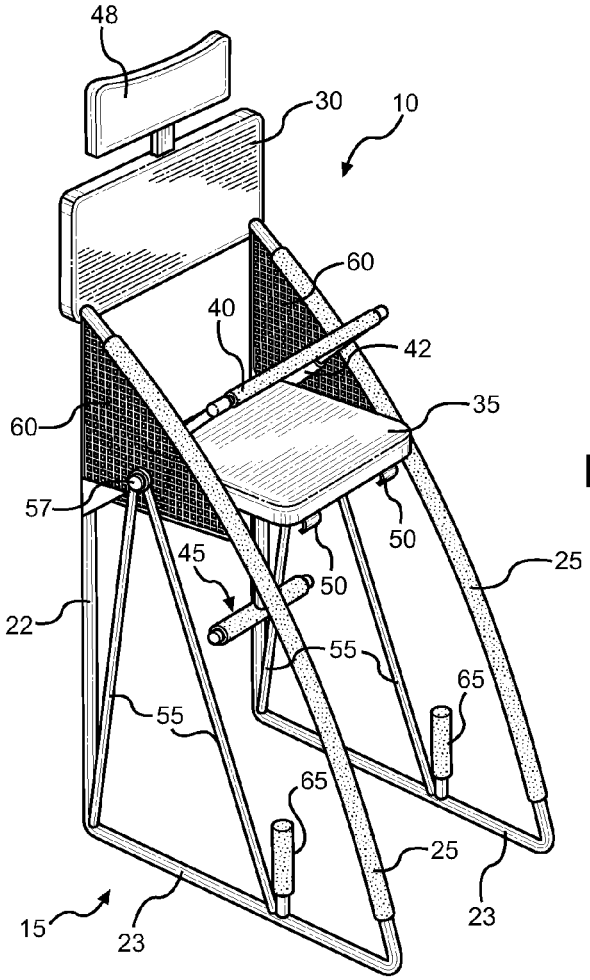

| | | | | |
|---|---|---|---|---|
| 5,967,956 | A | 10/1999 | Teeter | |
| D432,600 | S * | 10/2000 | Szabo | D21/662 |
| 6,464,296 | B1 | 10/2002 | Sumner | |
| 7,361,128 | B2 * | 4/2008 | Chen | A61H 1/0218 482/142 |
| 2001/0004165 | A1 * | 6/2001 | Sumner | A47C 3/0255 297/326 |
| 2003/0162639 | A1 * | 8/2003 | Hsien | A63B 21/068 482/144 |
| 2005/0009675 | A1 * | 1/2005 | Van Den Heever | A63B 21/0615 482/131 |
| 2005/0187084 | A1 * | 8/2005 | Tornabene | A63B 21/068 482/140 |
| 2006/0214476 | A1 * | 9/2006 | Rojas | A47C 4/30 297/3 |
| 2008/0061615 | A1 * | 3/2008 | McBride | A47C 1/02 297/325 |
| 2011/0301002 | A1 * | 12/2011 | Sebastian | A63B 21/068 482/140 |
| 2014/0070574 | A1 * | 3/2014 | Li | A47D 1/002 297/35 |

* cited by examiner

SEATED INVERSION CHAIR AND METHOD OF TREATING MIGRAINE HEADACHES

CROSS REFERENCE TO RELATED APPLICATION

This application claims the benefit of U.S. Provisional Application No. 61/804,963 filed on Mar. 25, 2013. The above identified patent application is herein incorporated by reference in its entirety to provide continuity of disclosure.

BACKGROUND OF THE INVENTION

Field of the Invention

The present invention relates to an inversion chair and the method of use. More specifically the invention relates to an inversion chair including a fixed backrest and a rotatable seat, whereby the inversion chair and the method of exercise are configured to provide a treatment for migraines. The chair is adapted to operate as either a standard, upright seat, or alternatively an invertible chair, depending on the position of a user support bar and the desires of the user at a given time. The treatment method combines the head muscles stretching and alteration of the blood flow within the head by utilizing the user's inverted position while using the chair.

Many individuals suffer from different types of headaches, such as tension, cluster, frontal sinus headaches, and migraines. Migraines are a common and serious neurovascular disorder that affects many individuals. These migraines may cause symptoms, such as throbbing headaches, nausea, vomiting, and light and sound sensitivity. The intense throbbing and pain associated with migraines are debilitating to individuals. Moreover, these migraines may cause a loss of productivity and functionality during everyday tasks.

A migraine headache is a result of the brain abnormal sensory modulation reaction to any environmental or physical changes. This definition refers to many different environmental or physical factors such as change in weather (humidity or temperature), change in barometric pressure, dry and dusty atmosphere, high winds, traveling, changing job or school, bright or flickering light, loud noise, intense smells or vapors, certain foods, alcohol, over sleeping, under sleeping, hormone fluctuation, stress and many more. Although the cause of the migraine differs for each individual, what is known is that it involves changes to the nerve pathways and chemicals of the brain. These changes may result in alteration of the flow of blood within the brain.

It is known that migraines occur as a result of environmental and/or physical triggers, these triggers may be different for each individual. For some individuals, however, may notice early symptoms called "prodrome". These symptoms can include one or more of dizziness, fatigue, mood changes, food cravings, changes in vision, and etc. Shortly after the noticed symptom the blood flow in the head begin to change gradually and muscle and nerve spasms start to cause pains in different areas of the head. These symptoms provide the first warning that a migraine is about to begin. If the headache is not properly treated on this stage it may develop and create a more painful and harder to treat situation. Traveling of the pain signals through the trigeminal nerve to the brain stem and then into the brain sensory receptor (thalamus) may cause brain nerve activation resulting in brain blood vessels dilation (vasodilatation). This is when the full blown migraine episode starts to happen. So, there is a time period between receiving early migraine symptoms and reaching the pain signals to the trigeminal nerve of a migraineur. This time period is the main focus of this invention which is referred to as "prodromal phase" in this document. Migraine prodromal phase has an onset of two hours to two days before the excruciating migraine pain starts.

Shortly after performing the present exercise method during the prodromal phase, the migraine headache start reversing before the pain signals can reach to the brain center and turn into a full blown migraine headache. The inverted position may allow the blood flow to evenly distribute through the head while the stretching exercise method cause to relieve any muscle or nerve spasm in the head area thus the travel of the pain signals to the brain center is being prevented or stopped within minutes.

The presented method of treatment using the inversion chair comprise of two sets of exercises which should be performed in the right order in order to get a complete relief from the migraine attack during the prodromal phase.

The present invention provides an apparatus and method of use that is adapted to stop the onset of a migraine at the first migraine attack signs during the prodromal phase. Moreover, the present invention can be utilized as a preventive measure as part of a schedule routine, wherein the device is used before the emergence of migraine symptoms. It is the goal of the present invention to enable an individual to orient themselves in an inverted position, thereby allowing the blood flow to evenly distribute into the head and neck area while head muscle stretching exercises are designed to relieve any muscle tensions or spasms, thereby preventing pain signals from traveling to the brain through the trigeminal nerve and before the headache may get out of control. Furthermore, in addition to preventing the migraine from occurring, the present method facilitates the strengthening of the head muscles, which can significantly decrease the frequency and the intensity of future migraine attacks by decreasing the susceptibility to any sudden environmental or physical change, as well as improving the overall health of the user.

The present invention provides an inversion chair combining with two complimentary exercise methods that are configured to provide therapeutic relief from migraine headaches. Based on the "Neurovascular Theory" of the migraine, the presented invention utilizes the basic fact that whether the abnormal reaction creating a migraine attack initially starts in nervous system or blood vessels or a combination of both it may cause an uneven blood flow which leads to head muscle spasm during the prodromal phase. The present chair is designed to orient a user in a position to even out the blood flow within the head including forehead, upper face, sides and back of the head, while the exercise methods release any spasm in the muscles or nerves in the mentioned areas as well as increasing the circulation of the oxygen which all, can create a reverse mechanism for migraine symptoms during the prodromal phase and stop the migraine attack within minutes. More importantly utilizing the chair and practicing the exercise method can significantly reduce the intensity and frequency of the future migraine attacks. The user then can keep up with practicing the exercise method and utilizing the inversion chair to maintain the results. When not needed as an inversion therapy device, the present chair is designed such that it can easily be converted into a traditional, upright chair that will not invert.

Since there is no known cure for migraine headaches, individuals spend considerable amounts of money on the treatment of attacks thereof. A variety of medications have been developed to treat these debilitating conditions; however these medications are taken every day as a preventive measure, or taken as needed to relieve the pain of an active migraine in progress. Most users would rather not take daily medication or be required to take medication after a migraine attack has already begun, which often times medications are also less effective if is not used earlier in an attack. The present invention is provided as a non-medicinal treatment that a user can engage in on a daily basis for acute attacks or daily maintenance.

Similar solutions currently available involve hanging one's self over a couch and bending over in a manner that changes the center of gravity of a user and alters blood flow. These solutions, however, are limited by the furniture around the house, which may not be capable of providing a proper treatment angle, may lack securing features, and lack the stability necessary to perform the migraine treatment. The present invention is presented as a safe and reliable method of inversion that does not require use of other furniture articles.

Existing inversion chairs in the art are furthermore designed to provide therapeutic treatment to the back of a user by relieving the pressure between the joints of the spine. Some of these treatment devices may also provide a change in blood flow, however, these devices typically have a solid headrest portion that restricts the movements of the head, and furthermore does not provide a chair that can be used as a traditional seat during periods of non-use as an inversion therapy device.

The present invention relates to a new and improved inversion chair that is configured to provide migraine treatment by altering the flow of blood within the head and neck area. The assembly provides a chair that can invert the user when desired, and operably act as an upright seat between uses with the repositioning of a support bar on the assembly. The assembly comprises a chair-supporting frame having first and second sides connected by a backrest. The sides of the frame comprise L-shaped members having an upstanding side member and a base member that are connected together by a curved member. A seat is rotatably connected to the sides of the frame. The seat comprises an upper user support bar and a lower leg support bar, which provide support for a user when in an inverted orientation. The user support bar is removable for either locking the chair in an upright position or for use as a lap support for the user when inverted.

Description of the Prior Art

Devices have been disclosed in the prior art that relate to inversion devices. These include devices that have been patented and published in patent application publications. These devices generally relate to devices that include long backrests that rotate backward to decompress the spine. The following is a list of devices deemed most relevant to the present disclosure, which are herein described for the purposes of highlighting and differentiating the unique aspects of the present invention, and further highlighting the drawbacks existing in the prior art.

One such device in the prior art is U.S. Pat. No. 5,967,956 to Teeter. The device provides a mount for a tilting inversion exercise table that is configured for rotatably supporting a user thereon. While the device of Teeter provides a rotation of a user similar to that of the present invention, it differs in that it fails to provide a fixed backrest and a seat that is rotatable.

Another device, U.S. Pat. No. 3,081,085 to Girolamo discloses a back posture and stretch board. The device provides a treatment that promotes proper back posture, while at the same time effect a stretching of the back. The device board of the device comprises handles, a sitting bad, and straps for securing the feet. In use, the board rotates backward while a user is lying on top of the board, thereby letting gravity decompress and stretch the spine. The device of Girolamo, however, differs from the present invention in that it fails to provide a rotatable seat that is configured to apply migraine relief, and furthermore a means of locking the seat when not used for its intended purpose.

U.S. Pat. No. 5,334,123 to Rutherford describes a device for performing a tilting exercise apparatus for the back. The device is a rearward tilting chair set within a frame, whereby the rotation of the chair facilitates the decompression of the spine of a user. The chair is tilted back to a limited degree so that while the spine is allowed to decompress, the blood does not rush to the head. While the device of Rutherford is similar in nature and relevant to the present invention, the device differs in that it fails to provide a rotatable seat having a fixed back, and further differs in that the rotational angle does not allow for the altering of blood flow within the head in order to provide migraine relief.

Yet another prior art device, U.S. Pat. No. 4,739,749 to Lindley describes an Orthospinal chair for exercising the spinal column and back muscles by placing tension on the spine through partial inversion. The chair comprises a restraining strap that is secured around the hip area of the user, thereby retaining the user in the chair during inversion. Although the device of Lindley provides an inversion chair similar to that of the present invention, it differs in that it fails to provide an inversion chair having a fixed backrest and a rotatable seat portion, whereby the chair is configured for the relief and treatment of migraines.

Finally, U.S. Pat. No. 6,464,296 to Sumner describes a therapeutic inversion chair. The device comprises a frame, having a pivotally connected chair, having different relative inclinations. When used for inversion, a stop is mounted on the chair to restrict rearward pivotal movement of a person from an upright position to an inverted position. While the device of Sumner is similar in nature and relevant to the present invention, it differs by failing to provide a fixed backrest and a rotatable seat having a leg support thereon.

The present invention is an inversion chair assembly configured to provide relief for a user who is experiencing or is about to undergo a migraine, whereafter the assembly can be locked in a static state for use as a traditional seating device. An invertible seat is connected between a first and second frame sides and can be locked into position or support a seated user when transitioning from an upright position to an inverted position. The seat is rotatable about the frame, and comprises lower leg and an upper user support bar, providing upper and lower body support for the user when the chair is inverted. The support bar is positionable over the lap of the user, or alternatively is movable to a position below the seat and between the frame sides within clips under the seat. The support bar extends and locks the seat in an upright state. The length of the support bar is adjustable to either be greater or smaller than the width between the frame sides, thereby locking the chair in a horizontal position when used in a traditional manner.

It is submitted that the present invention is substantially divergent in design elements from the prior art and consequently it is clear that there is a need in the art for an improvement to existing inversion chair devices. In this regard the instant invention substantially fulfills these needs.

SUMMARY OF THE INVENTION

In view of the foregoing disadvantages inherent in the known types of inversion chair devices and inversion therapy devices now present in the prior art, the present invention provides a new inversion chair assembly that can be utilized for providing convenience for the user when a therapeutic relief from migraines is desired, or a traditional, upright chair is desired.

It is therefore an object of the present invention to provide a new and improved inversion chair assembly that has all of the advantages of the prior art and none of the disadvantages.

It is another object of the present invention to provide an inversion chair assembly with a frame having a fixed backrest and a rotatable seat therein.

Another object of the present invention is to provide an inversion chair assembly with a rotatable seat having an upper user support bar and a lower leg support, whereby the upper and lower body of the user is secured when the assembly is used to invert the user.

Yet another object of the present invention is to provide an inversion chair assembly that includes a removable user support bar that is positionable above the seat as a lap support of the user, and removable and positionable beneath the seat to lock the chair in an upright configuration between uses.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 1A displays a perspective view of the inversion chair of the present invention when situated for use as an inversion chair, wherein the upper user support bar is positioned above the seat.

Figure 1B:
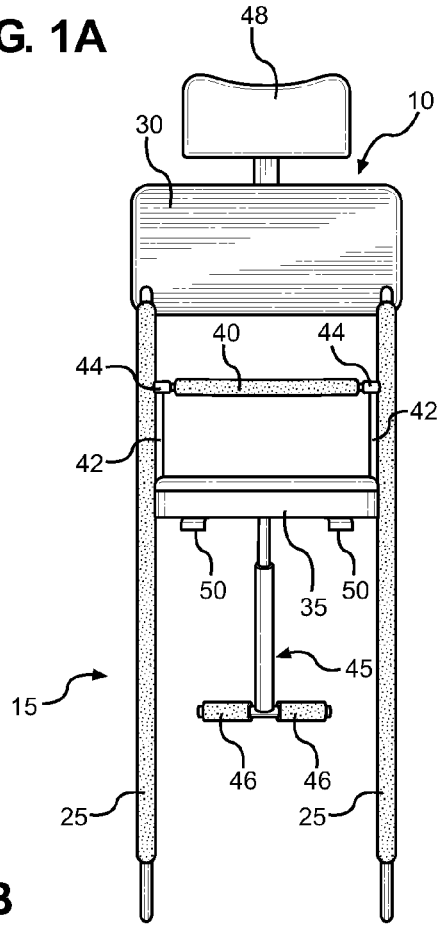

FIG. 1B displays a front view of the inversion chair of the present invention in the same state as FIG. 1A.

Figure 1C:
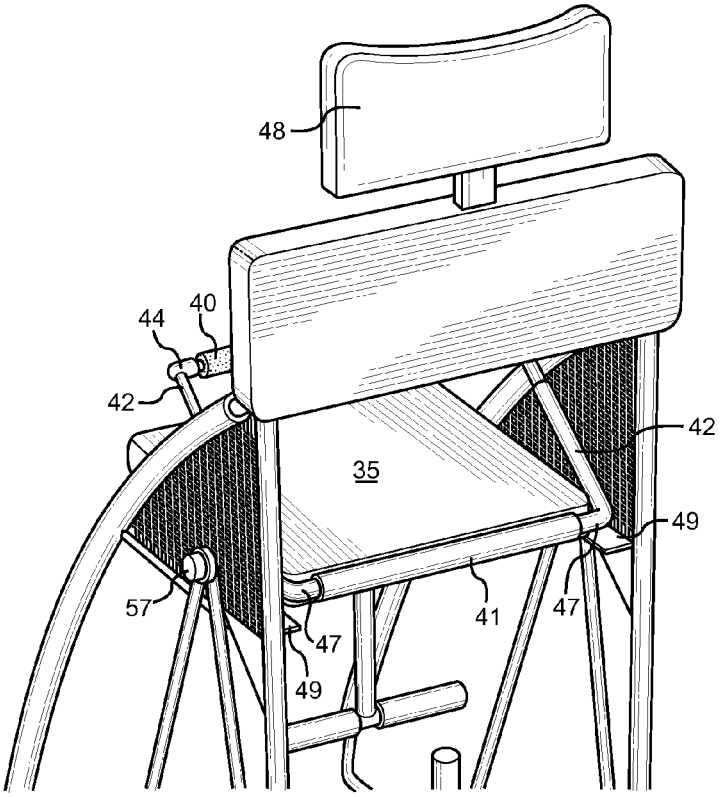

FIG. 1C displays a rear view of the inversion chair and the rotatable attachment of the support bar arms to the rear of the seat.

Figure 1D:
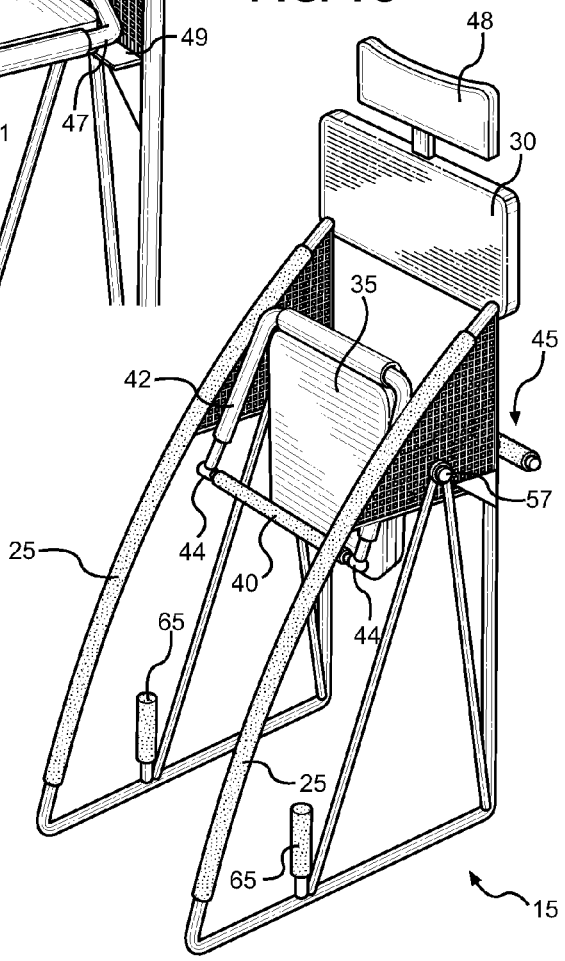

FIG. 1D displays the inversion chair of the present invention in an inverted state, wherein the chair is positioned in a vertical orientation while the upper support bar and the lower footrest are positioned to support the body of the user while inverted.

Figure 2A:
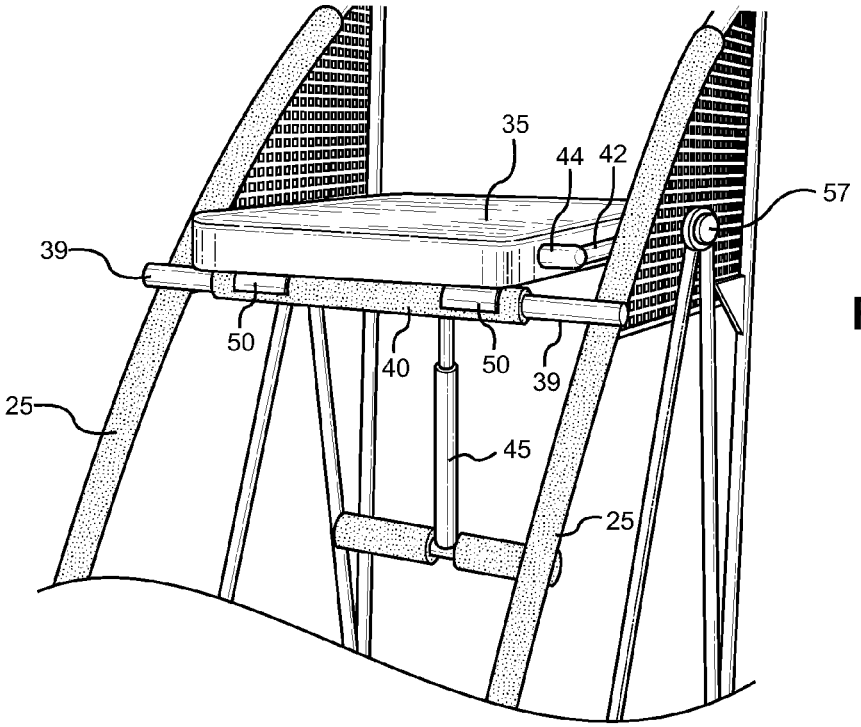

FIG. 2A displays a view of the inversion chair of the present invention when used as a traditional, upright chair. The upper user support bar is supported below the seat and in an extended state to prevent downward rotation of the seat.

Figure 2B:
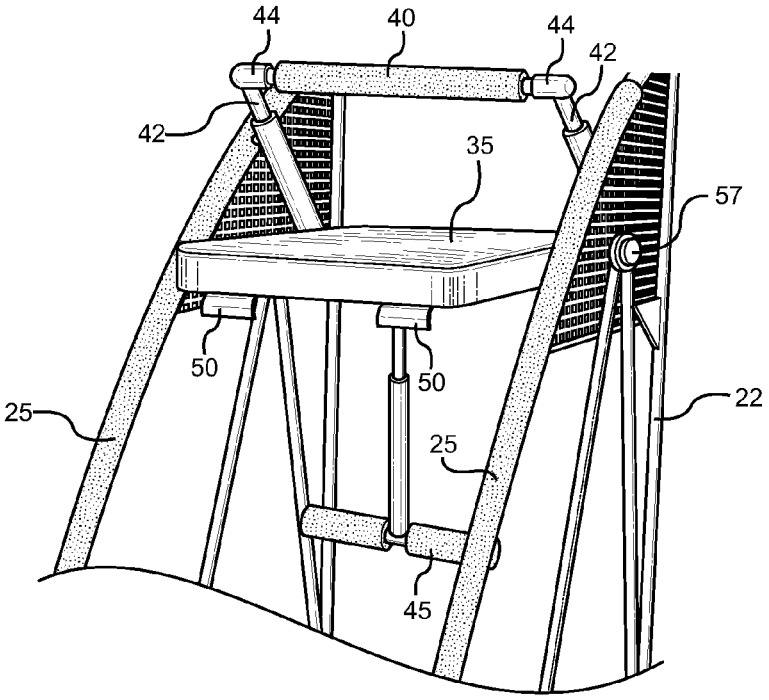

FIG. 2B displays a view of the inversion chair of the present invention when configured for use as an inversion chair.

Figure 2C:
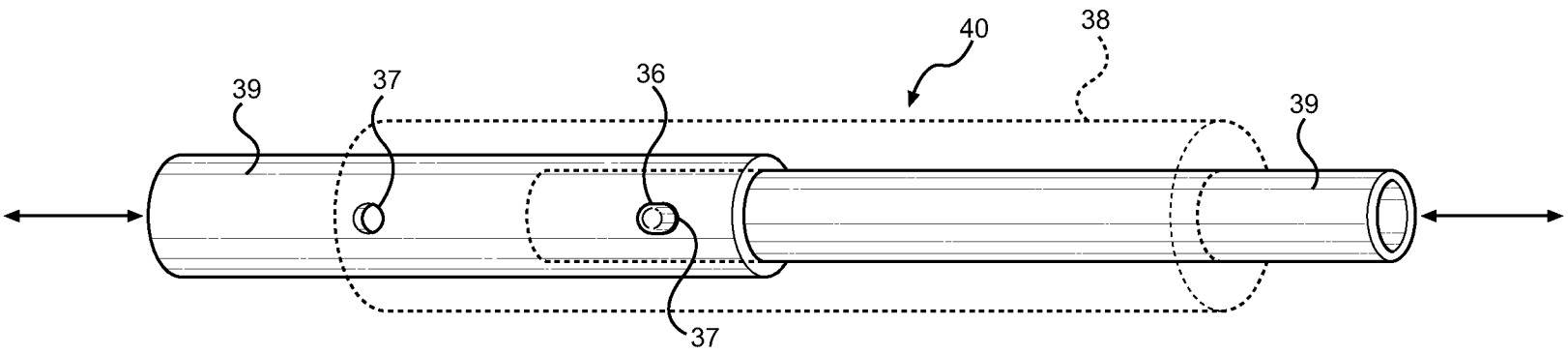

FIG. 2C displays a view of the user support bar and an embodiment of its outwardly extendable structure.

Figure 3:
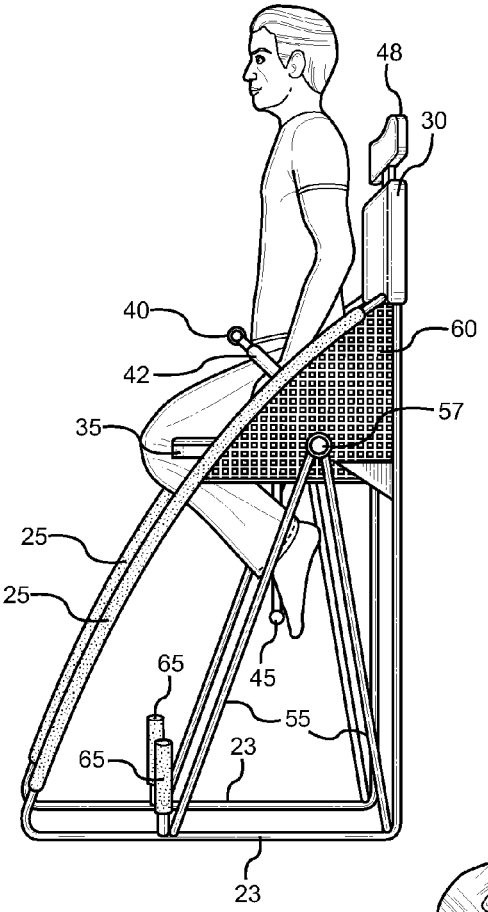

FIG. 3 displays a view of the device in use just prior to inversion, whereby the user is in an upright position.

Figure 4:
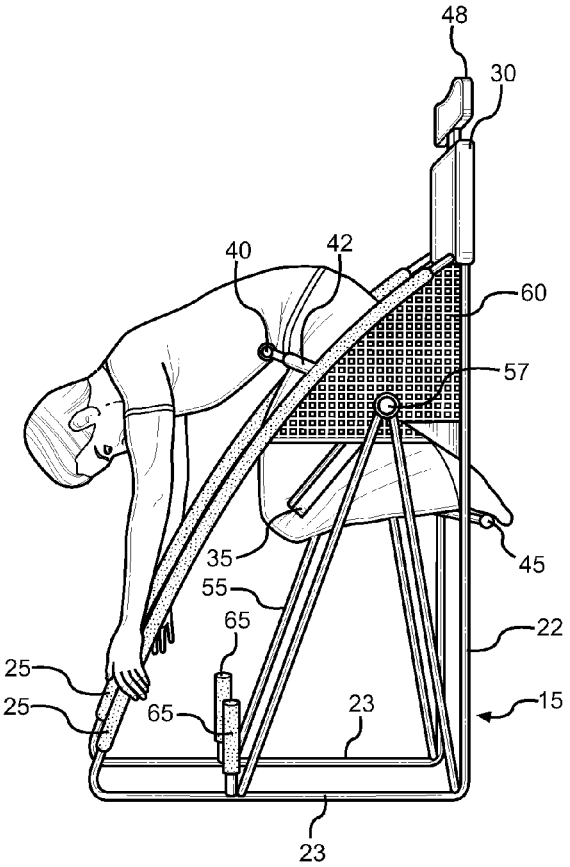

FIG. 4 displays a view of the device in use as an inversion chair as the user is transitioning from an upright position to an inverted position.

Figure 5:
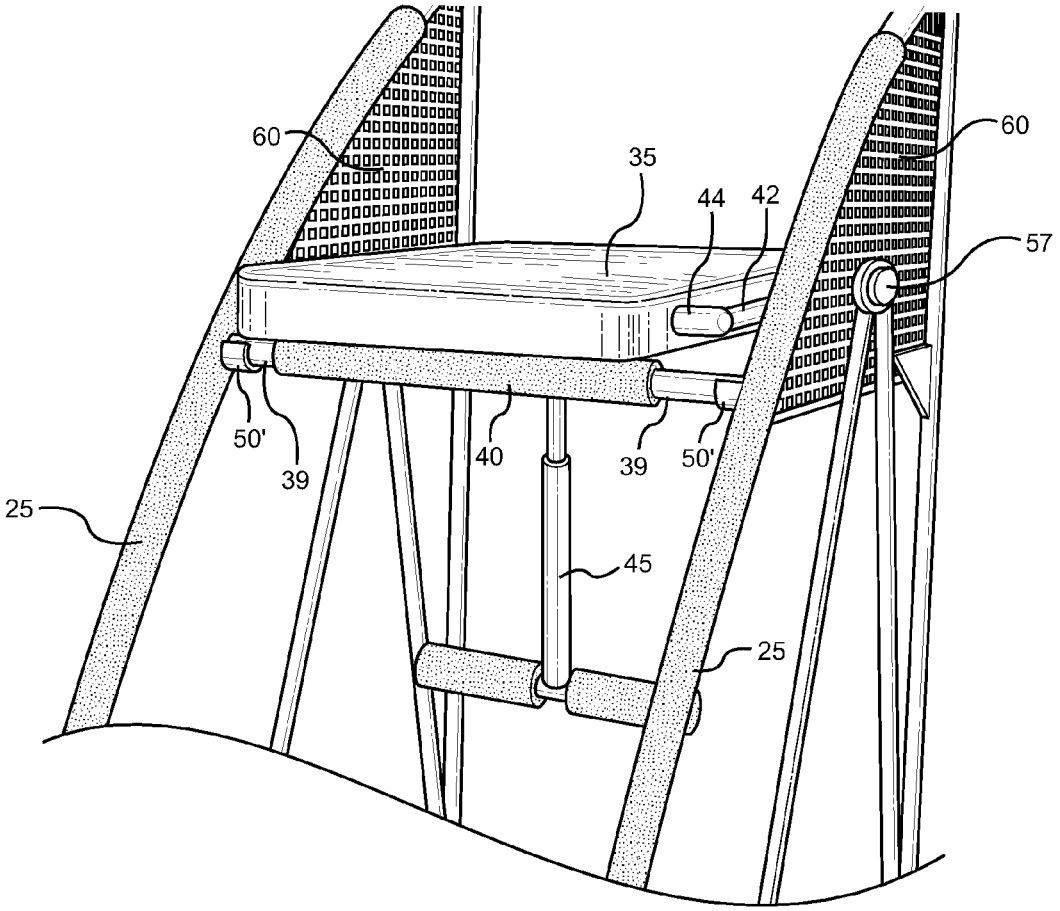

FIG. 5 displays a view of the inversion chair of the present invention when used as a traditional, upright chair and an alternate embodiment of the user support bar clip placement. The upper user support bar is supported below the seat by clips attached along the curved members.

DETAILED DESCRIPTION OF THE INVENTION

Reference is made herein to the attached drawings. Like reference numerals are used throughout the drawings to depict like or similar elements of the inversion chair. For the purposes of presenting a brief and clear description of the present invention, the preferred embodiment will be discussed as used for the treatment of migraines through inversion therapy or used as a traditional, upright chair between inversion therapy uses. The figures are intended for representative purposes only and should not be considered to be limiting in any respect.

Referring now to FIGS. 1A through 1D, there are shown perspective and frontal views of the inversion chair 10 of the present invention, which is configured for providing treatment for migraines by operably positioning a user in an inverted state when not acting as a traditional, upright chair. The assembly comprises a frame 15 having a first frame side and a second frame side that are substantially identical to one another and which are connected to each other by a backrest frame. The backrest frame 30 separates the frame sides and spans the gap therebetween, whereby the frame sides are parallel to one another and said backrest frame 30 is substantially perpendicular thereto. Each of the frame sides are a substantially L-shaped member comprising an upstanding member 22, a base member 23, and a curved member 25 connected therebetween to the ends of the upstanding member 22 and the base member 23. Along the base member 23 of each side frame is an upstanding post forming inversion grips 65 for an inverted user to grasp if necessary while inverted. The upstanding member 22 and curved member 25 connect to the sides of the backrest frame 30, thereby providing a stable frame 15 structure. The backrest frame 30 is preferably covered by a padding material, while the frame sides may have a soft covering to soften any contacts with a seated user. Extending upwards from the backrest frame 30 is an adjustable and/or removable headrest 48.

A seat 35 is rotatably supported between the first and second frame sides by a pair of angled, upstanding seat support members 55 and a pair of seat support plates 60, both of which are positioned in the same plane as the frame sides. The seat support plates 60 are secured within an upper area of frame sides and between the upstanding 22 and curved 25 frame members. The upstanding seat support members 55 form a triangular shape with an upper apex defined by the rotatable connection of the seat 35. A rotational joint 57 that includes a bore and pin supports the seat 35 in a rotatable condition, whereby the joints 57 of each frame side are aligned to allow the seat 35 to pivot from a substantially horizontal condition to a substantially vertical position. This enables a user to sit upright and to transfer into a substantially inverted position while seated in the seat.

The construction of the seat and its ability to rotate are visualized. The seat 35 preferably comprises a padded cushion positioned over a seat frame. Along the rear of the seat there is connected a first and second support bar arm 42, which is rotatably connected to the seat frame via a cylindrical sleeve 41 and a perpendicular portion of the support bar arms that forms an internal sleeve member 47 within the sleeve 41. This configuration forms a revolute joint or hinge joint between the arms 42 and the seat frame, thereby enabling the user support bar 40 to be advantageously positioned on the lap of a user. The first and second support bar arm 42 extend from the rear of the seat frame and terminate at a support bar socket 44, which is adapted to receive the end of the user support bar 40 positioned over the seat 35. The user support bar 40 is a removable structure that first serves as a support over the lap of an inverted user, and then alternatively as a means to lock the seat 35 in a horizontal state when the assembly is used as a standard, upright chair.

Along the rear of the seat 35 and positioned along the inward surface of the frame side is a rear seat support 49 (see FIG. 1C). The rear seat support 49 comprises a ledge that prevents the seat 35 from rotating backwards about its rotational joint 57. The rotational joint 57 is forward of the rear seat support 49, whereby the seat 35 can rotate freely forward, and rearward to the extent to which the seat lower surface contacts and bears against the rear seat supports 49. These elements allow the seat 35 to remain horizontal when the assembly is used as a standard, upright seat.

When the user support bar 40 is engaged into the sockets 44 of the arms 42, they move with the chair 35 itself as it transitions from an upright position to an inverted position. Likewise, below the chair there is positioned a footrest 45 with a first and second footrest perch 46 for the user to brace their lower body while inverted. The user support bar 40 is configured to retain a user against the seat 35 when the user is in an inverted position, while the footrest can be positioned over or under the user's feet to limit any relative motion between the user and the seat 35. The user support bar 40 is removably insertable into the sockets 44 of the support bar arms 42, thereby enabling a user to enter and exit the chair and further enable the repositioning of the user support bar under the seat 35 to lock the same in a horizontal position (see FIG. 2A). After the user support bar 40 is removed from the arms 42, the bar 40 may be placed within support bar clips 50 located along the underside of the seat 35 and the support arms 42 can be lowered to the same level as the seat 35 and be placed right beside the seat 35 (see FIG. 2A) on both sides. The user support bar 40 is length adjustable such that it remains shorter than the distance between the first and second frame sides while in use as an inversion chair (see FIG. 1B), and thereafter adapted to extend outward when the bar 40 is deployed below the seat to lock the same in a horizontal state (see FIG. 2A). This latter positioning of the bar 40 prevents the seat 35 from rotating when it is not intended.

Referring now to FIG. 2A there is shown a view of the seat 35 within the sides of the frame 15 being used as a traditional, upright chair. The user support bar 40 is first removed from sockets 44 of the support bar arms 42, thereby enabling a user to enter and exit the seat. The seat frame of the present invention comprises a forward end and a rear end, the rear end supporting the support bar arms 42 and the underside of the forward end comprising one or more support bar clips 50. The support bar clips 50 are configured to hold the user support bar 40 therein when the seat 35 is not in an inverted orientation. The length of the user support bar 40 is shorter than the width between the sides of the frame when used as an inversion chair, but its length is adjustable such that it can be extended when deployed below the seat 35. By adjusting the length of the support bar 40, users can create a greater length than the separation of the frame sides, whereafter the positioning of the user support bar 40 between the seat underside and the curved members 25 of the frame sides locks the seat 35 in a horizontal state and prevents rotation thereof. This secures the seat 35 from any sudden or unwanted rotational, enabling use thereof as a traditional chair.

Referring to FIG. 2A, The support bar arms 42 are also adjustable in angle with respect to the seat frame such that they can rotate the positioning of the support bar downwards or upwards based on user's body type and his or her comfort. The support bar arms 42 also act as optional handles that are hingedly supported from the seat 35 and are positioned at the sides of the seat 35 when the support bar 40 is removed at the end of treatment or when the seat is not used as a therapeutic inversion chair.

Referring now to FIG. 2B, there is shown a view of the present invention in a condition wherein the seat 35 is free to rotate about the frame sides, while the user support bar 40 and support arms 42 are supported over the lap of a user. Both the user support arms 42 and the leg supports 45 are length adjustable, in that they comprise a telescoping structure to enable longer or larger individuals to fit into the device, and the user supports to be sufficiently snug against the user to prevent the user from falling from the seat when inverted. When in use as an inversion chair, the user support bar 40 is removed from the clips 50 below the seat 35, and is secured within the sockets 44 of the support bar arms 42. The sockets 44 preferably comprise a locking mechanism to prevent inadvertent separation between the sockets 44 and user support bar 40. Meanwhile, the user support bar 40 may also comprises a padded exterior length. The support bar arms 42 are telescopic, and are configured to adjustably rest on the waist of a user when the inversion chair 10 is in use. Additionally, the leg supports 45 are also telescopic, thereby enabling users of varying heights to comfortably use the device.

The separation between of the support bar arms 42 and the width of the support bar 40 are shorter than the separation between the curved member 25 of the frame sides such that the support bar 40 can easily pass between the curved members 25 while the user is inverted. The functionality of the support bar 40 while attached to support bar arms 42 is to protect the user from falling out of the chair in an inverted position.

Referring now to FIG. 2C, there is shown a view of the user support bar 40 and its length adjustable construction. The user support bar 40 may take on several different designs allowing its length to be adjustable, and it is not desired to limit the design of the user support bar 40 to any one specific construction. The following is one contemplated means of adjusting the length of the user support bar 40, wherein the bar 40 comprises a first and second member 39 in telescopic relationship with one another. A first and second pin hole 37 location are provided for a spring pin 36 to be secured thereinto, thus providing a first and second locked length for the assembly. Along the length of the bar 40 may also be provided a padding material 38, whereby this material is softer on the user as it bears into the user when he or she is inverted.

Referring now to FIG. 3, there is shown a view of a user sitting on the seat 35 of the present invention with the user support bar 40 positioned between the frame sides and the bar over the lap of the user. The upper user support bar 40 and a lower leg support 45 are both telescopically extendable, while the user support bar 40 is rotatable with respect to the seat frame to facilitate comfortable positioning thereof against the user.

Referring now to FIGS. 3 and 4, the transition between an upright position and an inverted position is illustrated. Once secured by the user support bar 40 and after the arms 42 thereof have been rotated to a position such that the bar 40 is over the lap of the user, he or she is secured against the seat 35. The user holds on to the curved members 25 of the frame sides in order to remain secured while placing the legs against or behind the leg supports 45, which are positioned underneath the seat 35. During the transition to an inverted state, the user slides his or her hands along the curved members 25 such that the inversion is slow and controlled. The seat 35 rotates about its rotational joint 57 between the frame sides and the user slowly inverts. The user can then grasp the inversion handles 65 at the base of the frame sides. While seated and when inverted, the structure of the frame 15 (base members 23, upstanding members 22, curved members 25, seat support plates 60, and the backrest frame 30) remains static and stable as the seat is permitted to rotate and invert the user.

To provide relief from a migraine, the user leans forward and rotates the seat forward from its horizontal position until the seat 35 is substantially vertical. In this position, the upper body of the user assumes an inverted position in relation to the frame 15 of the device 10. The user may then orient his or her head in various positions and perform exercise methods that facilitate a change in blood flow within the head, thereby providing therapeutic relief from the migraine.

The frame 15 comprises a plurality of grasping mechanisms that provide a user with locations to enable a user to obtain and/or remain in a desired orientation when rotated forward. The base member 23 of the frame 15 comprises inversion grips 65, which enable a user to stay in a full inverted position when rotated forward in the seat 35. Additionally, the curved member 25 comprises padding that facilitates grasping by a user, whereby the curved member 25 and the inversion grips 65 enable a user to remain at differing angles as for some users a full 180 degree inversion angle may not be suggested.

Referring now to FIG. 5, there is shown a view of the inversion chair of the present invention in a state such that the seat 35 is supported by the user support bar 40 thereunder, whereby the assembly can be deployed as a traditional, upright chair. This view illustrates an alternate embodiment of the present invention, wherein a first and second user support bar clip 50' are located on first and second frame side (either along the curved members 25 or alternatively along the seat support plates 60), as opposed to be disposed along the underside of the seat frame. In this configuration, the telescopic members 39 of the user support bar 40 are extended outward such that the ends thereof rest within the clips 50' and the bar 40 is positioned below the seat 35 and between the curved members 25. As with the first embodiment, the bar 40 is removed from the sockets 44 of the user support arms 42 and placed below the seat 35 to prevent rotation of the same about its joint 57.

In use, an individual may enter the chair by removing the padded support bar 40 from the support bar arms 42, or may enter the chair if the support bar 40 is positioned within the clips 50. The user can remove the bar 40 from the clips 50, then raise the support bar arms 42 from the sides of the seat 35 and secure the support bar 40 within the support bar arms 42 in order to securely position him/herself within the chair and adjust the height and angle of the support bar arms 42, thereby providing comfort for the user. Thereafter, the user can grasp the pair of curved members 25 to remain securely in place and then safely position his or her feet behind the adjustable footrest 45.

After being secured within the chair 10, the user may then by grasping the pair of curved members 25 slowly lean forward while advancing their grasp and pulling themselves downward, thereby facilitating the forward rotation of the seat 35 and raises the legs behind the user. Continued advancement along the curved members 25 brings the user into a substantially inverted orientation as displayed in FIG. 4. The hands of the user would then be in proximity to the pair of lower inversion grips 65, whereby the user can hold each of the grips 65 in order to sustain a controlled inverted orientation.

While inverted, the user may perform the first set of exercises to increase the blood flow while stretching out all sets of muscles around the head including forehead, upper face, sides and back of the head. After the user is controllably inverted, blood flow should become fairly stable in about ten seconds. Then the user may perform an internal breath retention by first taking a deep breath then holding on to the breath by pushing back the rear part of the tongue on the soft palate to block all the airway passages through the back of the mouth. Then the user may perform a total contraction of the abdominal muscles tightly to push the inhaled air out of the lungs while still blocking all the airways passages. Stay on the pulmonary airflow push up position for bout 5-8 seconds. Then remove the tongue from the soft palate and release the air out through the nostrils and mouth at once and relax the abdominal muscles for about 5-8 seconds while still inverted. This controllable movement can deeply stretch out all the muscles around the head including forehead, upper face, sides and back of the head as well as pumping and circulating the blood and oxygen flow through the vessels in these areas. The first exercise process may be repeated about four times. The user remains stationary in the inverted position at all times during the first exercise method.

The user may then let go of the inversion grips 65 and grab onto the curved members 25 and advance his or her grip along the curved members 25, thereby facilitating the advancement of the user to an upright sitting position as displayed in FIG. 3. Then the user removes his or her feet from behind the adjustable footrest 45. Thereafter, the user may let go of the curved members 25 and then remove the user support bar 40 from the arms 42 and secure the support bar 40 within the clips 50 located underneath the seat 35. Then the user may lower the first and second support bar arms 42 to the same level as the seat 35, displayed in FIG. 2A, and get ready for the second set of exercises. At the upright position the user may seat back and lean the head back against the headrest and remain stationary for about five minutes to allow the concentration of the blood move back from the face as well as the circulation of the blood through the head return back to normal.

Then the user may remove the head from the headrest and keep the head straight while seating in an upright position and begin to perform the second set of exercises. The user then may start the second exercise method by holding a pen vertically in front of the face and in contact with the tip of his/her nose. Then the user may keep the eyes wide open and start looking at the connecting point between the pen and the tip of the nose while raising the eyebrows as high as possible and keeping the lips closed. The user may stay in this position and keep the view direction on the same spot at all times in about 20-30 seconds. Then the user may relax by removing the pen away from the face and looking straight ahead at a distant object as well as keeping the eyes in a natural position for about one minute before repeating this process again. This second exercise process may also be repeated about four times.

The second exercise method focuses on stretching the muscles of the forehead, temples and upper face (sinus area)

which is necessary for the muscle fixation as well as blood vessels circulation adjustment in the forehead and upper face area right after performing the first exercise method.

The user may then exit the inversion chair 5 minutes after performing the first and second exercises.

Positive results should begin to occur about five minutes after completion of the first and second exercise processes. If however, any signs of migraine pain remain about twenty minutes after performing the first and second sets of exercise methods, the pair of exercises may be repeated until all signs of migraine have subsided.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An inversion chair for providing therapeutic treatment of migraines, comprising:

a frame having a first frame side and a second frame side connected by an upper backrest frame, whereby said first frame side and said second frame side are parallel to one another and said backrest frame spans therebetween;

said first frame side and said second frame side each comprise an upstanding member and a base member forming a substantial L-shape, whereby a curved member extends between said upstanding member and said base member;

a seat frame rotatably connected to said frame between said first frame side and said second frame side;

said seat frame adapted to rotate from a substantially horizontal orientation to a substantially vertical orientation, permitting a normal seating position or an inverted seating position, respectively;

a leg support suspended below said seat frame;

a first support bar arm and a second support bar arm, each rotatably connected to said seat frame;

said first and second support bar arms removably supporting a user support bar above said seat frame;

said user support bar being removably attachable to said first and second support bar arms and removably attachable below said seat frame;

said user support bar comprising a length adjustable construction such that said user support bar is adapted to be shorter than a separation between said first frame side and said second frame side when attached to said first and second support bar arms, and alternatively said user support bar is adapted to be longer than the separation between said first frame side and said second frame side when attached below said seat frame.

2. The inversion chair of claim 1, wherein:

said seat frame comprises a forward end and a rear end;

said first and second support bar arms rotatably secure to said rear end of said seat frame via a hinge joint.

3. The inversion chair of claim 1, wherein:

said seat frame comprises a forward end and a rear end;

said seat frame further comprises one or more support bar clips located along an underside of said seat frame along said forward end; and whereby said user support bar is removable attachable to said one or more support bar clips.

4. The inversion chair of claim 1, wherein:

said seat frame comprises a forward end and a rear end;

said seat forward end extending outward from the curved member of said first frame side and said second frame side;

said seat frame further comprises one or more support bar clips located along an underside of said seat frame along said forward end;

whereby said user support bar is removable attachable to said one or more support bar clips;

wherein said user support bar bears against said curved member of said first frame side and said second frame side when secured to said one or more support bar clips and when said user support bar length is extended to be greater than the separation of said first frame side and said second frame side.

5. The inversion chair of claim 1, wherein:

said seat frame comprises a forward end and a rear end;

said seat frame further comprises one or more support bar clips located along said first frame side and said second frame side; and whereby said user support bar is removable attachable to said one or more support bar clips.

6. The inversion chair of claim 1, wherein:

said seat frame comprises a forward end and a rear end;

said seat forward end extending outward from the curved member of said first frame side and said second frame side;

said seat frame further comprises one or more support bar clips located along said first frame side and said second frame side;

whereby said user support bar is removable attachable to said one or more support bar clips;

wherein said user support bar is supported by said one or more support bar clips of said first frame side and said second frame side and said seat frame bears against said user support bar when said user support bar length is extended to engage said one or more support bar clips and positioned therebetween.

7. The inversion chair of claim 1, wherein said base member comprises a hand grip on each of said first frame side and said second frame side of said frame, thereby enabling a user to maintain a desired orientation.

8. The inversion chair of claim 1, wherein said curved member comprises a gripping surface, thereby enabling a user to maintain a desired orientation.

9. The inversion chair of claim 1, wherein said backrest remains fixed when said seat rotates about said frame.

10. The inversion chair of claim 1, wherein said first frame side and said second frame side further comprise:

a first upstanding seat support member and a second upstanding seat support member forming a triangular shaped structure in plane with said first frame side and said second frame side;

said triangular shaped structure comprising an upper apex comprising a rotatable connection to said seat frame.

11. The inversion chair of claim 1, wherein said first frame side and said second frame side further comprise:

a first upstanding seat support member and a second upstanding seat support member forming a triangular shaped structure in plane with said first frame side and said second frame side;

said triangular shaped structure comprising an upper apex comprising a rotatable connection to said seat frame;

a seat support plate secured within an upper area of said first frame side and said second frame side and between said upstanding member and curved member thereof;

said seat support plate supporting said upper apex.

12. The inversion chair of claim 1, wherein said first frame side and said second frame side further comprise a rear seat support that prevents said seat frame from rotating rearward beyond horizontal.

13. The inversion chair of claim 1, wherein said backrest frame further comprises a headrest extending upward therefrom.

* * * * *